US011766132B2

(12) United States Patent
Ren et al.

(10) Patent No.: US 11,766,132 B2
(45) Date of Patent: Sep. 26, 2023

(54) ADJUSTABLE BED WITH TILTING MECHANISMS

(71) Applicant: Nisco (Thailand) Co., Ltd, Chonburi (TH)

(72) Inventors: Zhong Ren, Jiangsu (CN); Wei Wang, Jiangsu (CN); Jian Xie, Jiangsu (CN); Yifan Mao, Jiangsu (CN)

(73) Assignee: NISCO (THAILAND) CO., LTD, Chonburi (TH)

( * ) Notice: Subject to any disclaimer, the term of this patent is extended or adjusted under 35 U.S.C. 154(b) by 110 days.

(21) Appl. No.: 16/895,085

(22) Filed: Jun. 8, 2020

(65) Prior Publication Data

US 2020/0397147 A1 Dec. 24, 2020

Related U.S. Application Data

(60) Provisional application No. 62/862,824, filed on Jun. 18, 2019.

(51) Int. Cl.
*A47C 20/04* (2006.01)
*A47C 19/02* (2006.01)

(52) U.S. Cl.
CPC ..... *A47C 20/041* (2013.01); *A47C 19/021* (2013.01)

(58) Field of Classification Search
CPC .... A47C 20/041; A47C 19/021; A47C 19/045
USPC ..... 5/618
See application file for complete search history.

(56) References Cited

U.S. PATENT DOCUMENTS

| | | | | | |
|---|---|---|---|---|---|
| 4,715,073 | A * | 12/1987 | Butler | A61G 7/005 | 5/607 |
| 4,856,129 | A * | 8/1989 | Butler | A47C 19/045 | 5/509.1 |
| 5,165,753 | A * | 11/1992 | Henderson | A61G 5/14 | 297/DIG. 10 |
| 5,566,412 | A * | 10/1996 | Arnold | A47C 19/045 | 5/509.1 |
| 6,772,462 | B1 * | 8/2004 | Harrell | A47C 19/045 | 5/660 |
| 7,802,331 | B2 * | 9/2010 | Brown | A47C 19/045 | 5/610 |
| 8,858,409 | B2 * | 10/2014 | Trees | A61G 7/0513 | 601/24 |
| 9,642,757 | B2 * | 5/2017 | Sheppard | A47C 20/041 | |
| 10,179,077 | B2 * | 1/2019 | Poulos | A61G 7/0506 | |
| 2014/0041121 | A1 * | 2/2014 | Shan | A47C 21/006 | 5/618 |

(Continued)

*Primary Examiner* — David R Hare
*Assistant Examiner* — Luke Hall
(74) *Attorney, Agent, or Firm* — Locke Lord LLP; Tim Tingkang Xia, Esq.

(57) ABSTRACT

An adjustable bed includes a bed frame supporting a plurality of platforms having at least a head platform and a back platform, a back lifting assembly, a foot lifting assembly, a base frame pivotally and detachably connected to the bed frame, a bed frame tilting actuator pivotally connected to the bed frame and the base frame for operably adjusting the bed frame from the horizontal position to the sloping position relative to the base frame, or vice versa. The adjustable bed also includes a head platform tilting actuator pivotally connected to the head platform and the back platform for operably adjusting the head platform in a tilting position or a flat position relative to the back platform.

14 Claims, 9 Drawing Sheets

(56) References Cited

U.S. PATENT DOCUMENTS

| | | | | |
|---|---|---|---|---|
| 2017/0166104 | A1* | 6/2017 | Gilmore | A47C 19/045 |
| 2018/0103770 | A1* | 4/2018 | Nava | A61G 7/015 |
| 2018/0338625 | A1* | 11/2018 | Nava | A47C 19/021 |
| 2019/0142177 | A1* | 5/2019 | Brown | A47C 20/041 5/618 |
| 2019/0191890 | A1* | 6/2019 | Huang | A47C 20/10 |
| 2020/0154899 | A1* | 5/2020 | Brown | A47C 20/12 |
| 2020/0187662 | A1* | 6/2020 | Zeng | A47C 19/122 |

* cited by examiner

ADJUSTABLE BED WITH TILTING MECHANISMS

CROSS-REFERENCE TO RELATED PATENT APPLICATION

This application claims priority to and the benefit of U.S. Provisional Patent Application Ser. No. 62/862,824, filed Jun. 18, 2019, which is incorporated herein in its entirety by reference.

FIELD OF THE INVENTION

The invention generally relates to a bed, and more particular to an adjustable bed with tilting mechanisms.

BACKGROUND OF THE INVENTION

Sleep is critical for people in every aspect of their lives. Beds are necessary furniture for people to sleep on. Adjustable beds are used more and more in healthcare and home. However, the adjustability of conventional adjustable beds is very limited. Thus, it would be beneficial and desirable for people to have a bed system that is capable of adjusting body positions at user's preference so that the user achieves maximum comfort when using the bed system.

SUMMARY OF THE INVENTION

In one aspect, the invention relates to an adjustable bed comprising a bed frame, a back lifting assembly, a foot lifting assembly, and a tilting mechanism coupled to the bed frame for operably adjusting the bed frame from a horizontal position to a sloping position, or vice versa.

In one embodiment, the bed frame comprises a pair of side rails, an upper rail and a lower rail, wherein the pair of side rails is transversely spaced, longitudinally aligned and arranged parallel to each other, each side rail having a first end and an opposite, second end; and the upper rail and the lower rail are longitudinally spaced and transversely aligned, two ends of the upper rail being connected to the first ends of the pair of side rails and two ends of the lower rail being connected to the second ends of the pair of side rails such that the upper rail and the lower rail are parallel to each other.

In one embodiment, the back lifting assembly comprises a back lifting bracket pivotally connected to the pair of side rails, and a back lifting actuator pivotally connected between the back lifting bracket and the upper rail for operably driving the back lifting bracket to pivotally move in an upward rotation direction or a downward rotation direction relative to the bed frame.

In one embodiment, the back lifting bracket comprises a pair of swing arms and a middle bar, wherein the pair of swing arms is transversely spaced and longitudinally extended, and rigidly connected to ends of the transversely extending middle bar in an H-shaped form, and each of the pair of swing arms has a first end portion and an opposite, second end portion, wherein the first end portion of each swing arm is pivotally mounted to a respective one of the pair of side rails of the bed frame through a pivot. In one embodiment, the second end portion of each of the pair of swing arms is equipped with at least one back lifting wheel.

In one embodiment, the back lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the upper rail of the bed frame through a first mounting bracket, and the activation rod has a distal end portion pivotally connected to the middle bar of the back lifting bracket through a second mounting bracket.

In one embodiment, the foot lifting assembly comprises a foot lifting bracket pivotally connected to the pair of side rails, and a foot lifting actuator pivotally connected between the foot lifting bracket and the lower rail for operably driving the foot lifting bracket to pivotally move in an upward rotation direction or a downward rotation direction relative to the bed frame.

In one embodiment, the foot lifting bracket comprises a pair of swing arms and a middle bar, wherein the pair of swing arms is transversely spaced and longitudinally extended, and rigidly connected to ends of the transversely extending middle bar in an H-shaped form, and each of the pair of swing arms has a first end portion and an opposite, second end portion, wherein the first end portion of each swing arm is pivotally mounted to a respective one of the pair of side rails of the bed frame through a pivot. In one embodiment, the second end portion of each of the pair of swing arms and is equipped with at least one foot lifting wheel.

In one embodiment, the foot lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the lower rail of the bed frame through a first mounting bracket, and the activation rod has a distal end portion pivotally connected to the middle bar of the foot lifting bracket through a second mounting bracket.

In one embodiment, the tilting mechanism comprises a base frame pivotally and detachably connected to the bed frame; and a bed frame tilting actuator pivotally connected to the bed frame and the base frame for operably adjusting the bed frame from the horizontal position to the sloping position, or vice versa.

In one embodiment, the base frame comprises a pair of side rails, an upper rail, a lower rail and an intermediate rail, wherein the pair of side rails is transversely spaced, longitudinally aligned and arranged parallel to each other, each side rail having a first end and an opposite, second end; wherein two ends of the upper rail are connected to the first ends of the pair of side rails; two ends of the lower rail are connected to the second ends of the pair of side rails; and two ends of the intermediate rail are connected to the pair of side rails at a position between the first ends and the second ends of the pair of side rails, such that the upper rail, the lower rail and the intermediate rail are parallel to each other.

In one embodiment, a pair of first brackets is respectively connected to the pair of side rails of the bed frame at positions proximate to the second ends of the pair of side rails; a pair of second brackets is connected to the lower rail of the base frame at positions respectively proximate to the two ends of the lower rail; and wherein the base frame is pivotally connected to the bed frame through a pair of shoulder bolts pivotally connecting the pair of first brackets to the pair of second brackets, respectively.

In one embodiment, the bed frame tilting actuator comprises at least one actuator, each actuator having a motor member, an outer tube extending from the motor member, an activation rod received in the outer tube, engaged with the motor member and configured to be telescopically expandable or contractible relative to relative to the outer tube according to a direction of motor rotation, wherein the motor member is pivotally connected to the intermediate rail or the upper rail of the base frame through a first mounting bracket, and the activation rod has a distal end portion pivotally connected to an intermediate rail of the bed frame through a second mounting bracket, such that an expansion of the activation rod causes the bed frame to pivotally move in an upward rotation direction so as to adjust the bed frame from the horizontal position to the sloping position, and an contraction of the activation rod causes the bed frame to pivotally move in an downward rotation direction so as to adjust the bed frame from the sloping position to the horizontal position.

In one embodiment, the adjustable bed further comprises a plurality of platforms disposed on the bed frame, the plurality of platforms comprising a head platform, a back platform, a waist platform, a seat platform, a thigh platform and a foot platform, wherein the back platform is movably coupled with the back lifting assembly, the seat platform is mounted onto the bed frame, and the thigh platform and the foot platform are movably coupled with the foot lifting assembly, wherein the waist platform is connected to the seat platform with one or more hinges, the seat platform, in turn, is connected to the thigh platform with one or more hinges, and the thigh platform, in turn, is connected to the foot platform with one or more hinges, and wherein the back platform and the waist platform are joined with angle limit brackets.

In one embodiment, the adjustable bed further comprises a head platform tilting actuator pivotally connected to the head platform and the back platform for operably adjusting the head platform in a tilting position or a flat position relative to the back platform.

In one embodiment, the head platform tilting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the back platform through a back platform mounting bracket, and the activation rod has a distal end portion pivotally connected to the head platform through a head platform mounting bracket having a reinforcement angle bracket holding a lower edge portion of the head platform and a mounting bracket protruded from the reinforcement angle bracket and mounted onto the head platform.

In one embodiment, the adjustable bed further comprises a controller configured to control operations of the head platform tilting actuator, the back lifting actuator, the foot lifting actuator, and the bed frame tilting actuator, respectively, so as to adjust individually or cooperatively the head platform, the back lifting platform, the thigh platform, the leg platform, and the bed frame in desired positions.

In another aspect, the invention relates to an adjustable bed, comprising a bed frame for supporting a plurality of platforms having at least a head platform and a back platform, wherein the bed frame comprises a pair of side rails, an upper rail, a lower rail and an intermediate rail arranged in a rectangle form; a base frame pivotally and detachably connected to the bed frame, wherein the base frame comprises a pair of side rails, an upper rail, a lower rail and an intermediate rail arranged in a rectangle form; and a bed frame tilting actuator pivotally connected to the bed frame and the base frame for operably adjusting the bed frame from a horizontal position to a sloping position, or vice versa.

In one embodiment, the bed frame tilting actuator comprises at least one actuator, each actuator having a motor member, an outer tube extending from the motor member, an activation rod received in the outer tube, engaged with the motor member and configured to be telescopically expandable or contractible relative to relative to the outer tube according to a direction of motor rotation, wherein the motor member is pivotally connected to the intermediate rail or the upper rail of the base frame through a first mounting bracket, and the activation rod has a distal end portion pivotally connected to the intermediate rail of the bed frame through a second mounting bracket, such that an expansion of the activation rod causes the bed frame to pivotally move in an upward rotation direction so as to adjust the bed frame from the horizontal position to the sloping position, and an contraction of the activation rod causes the bed frame to pivotally move in an downward rotation direction so as to adjust the bed frame from the sloping position to the horizontal position.

In one embodiment, the adjustable bed further comprises a back lifting assembly comprising a back lifting bracket pivotally connected to the pair of side rails, and a back lifting actuator pivotally connected between the back lifting bracket and the upper rail for operably driving the back lifting bracket to pivotally move in an upward rotation direction or a downward rotation direction relative to the bed frame.

In one embodiment, the back lifting bracket comprises a pair of swing arms and a middle bar, wherein the pair of swing arms is transversely spaced and longitudinally extended, and rigidly connected to ends of the transversely extending middle bar in an H-shaped form, and each of the pair of swing arms has a first end portion and an opposite, second end portion, wherein the first end portion of each swing arm is pivotally mounted to a respective one of the pair of side rails of the bed frame through a pivot.

In one embodiment, the back lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the upper rail of the bed frame through a first mounting bracket, and the activation rod has a distal end portion pivotally connected to the middle bar of the back lifting bracket through a second mounting bracket.

In one embodiment, the adjustable bed further comprises a foot lifting assembly comprising a foot lifting bracket pivotally connected to the pair of side rails, and a foot lifting actuator pivotally connected between the foot lifting bracket and the lower rail for operably driving the foot lifting bracket to pivotally move in an upward rotation direction or a downward rotation direction relative to the bed frame.

In one embodiment, the foot lifting bracket comprises a pair of swing arms and a middle bar, wherein the pair of swing arms is transversely spaced and longitudinally extended, and rigidly connected to ends of the transversely extending middle bar in an H-shaped form, and each of the pair of swing arms has a first end portion and an opposite, second end portion, wherein the first end portion of each swing arm is pivotally mounted to a respective one of the pair of side rails of the bed frame through a pivot.

In one embodiment, the foot lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the lower rail of the bed frame through a first mounting bracket, and the activation rod has a distal end portion pivotally connected to the middle bar of the foot lifting bracket through a second mounting bracket.

In one embodiment, the adjustable bed further comprises a head platform tilting actuator pivotally connected to the head platform and the back platform for operably adjusting the head platform in a tilting position or a flat position relative to the back platform.

In one embodiment, the head platform tilting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the back platform through a back platform mounting bracket, and the activation rod has a distal end portion pivotally connected to the head platform 1 through a head platform mounting bracket having a reinforcement angle bracket holding a lower edge portion of the head platform and a mounting bracket protruded from the reinforcement angle bracket and mounted onto the head platform.

In yet another aspect, the invention relates to an adjustable bed comprising bed frame for supporting a plurality of platforms having at least a head platform and a back platform; and a head platform tilting actuator pivotally connected to the head platform and the back platform for operably adjusting the head platform in a tilting position or a flat position relative to the back platform. The head platform tilting actuator comprises a motor member, an outer tube extending from the motor member, an activation rod received in the outer tube, engaged with the motor member and configured to be telescopically expandable or contractible relative to the outer tube according to a direction of motor rotation, such that an expansion of the activation rod causes the head platform to pivotally move in an upward rotation direction so as to adjust the head platform from the flat position to the tilting position, and an contraction of the activation rod causes the head platform to pivotally move in an downward rotation direction so as to adjust the head platform from the tilting position to the flat position.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
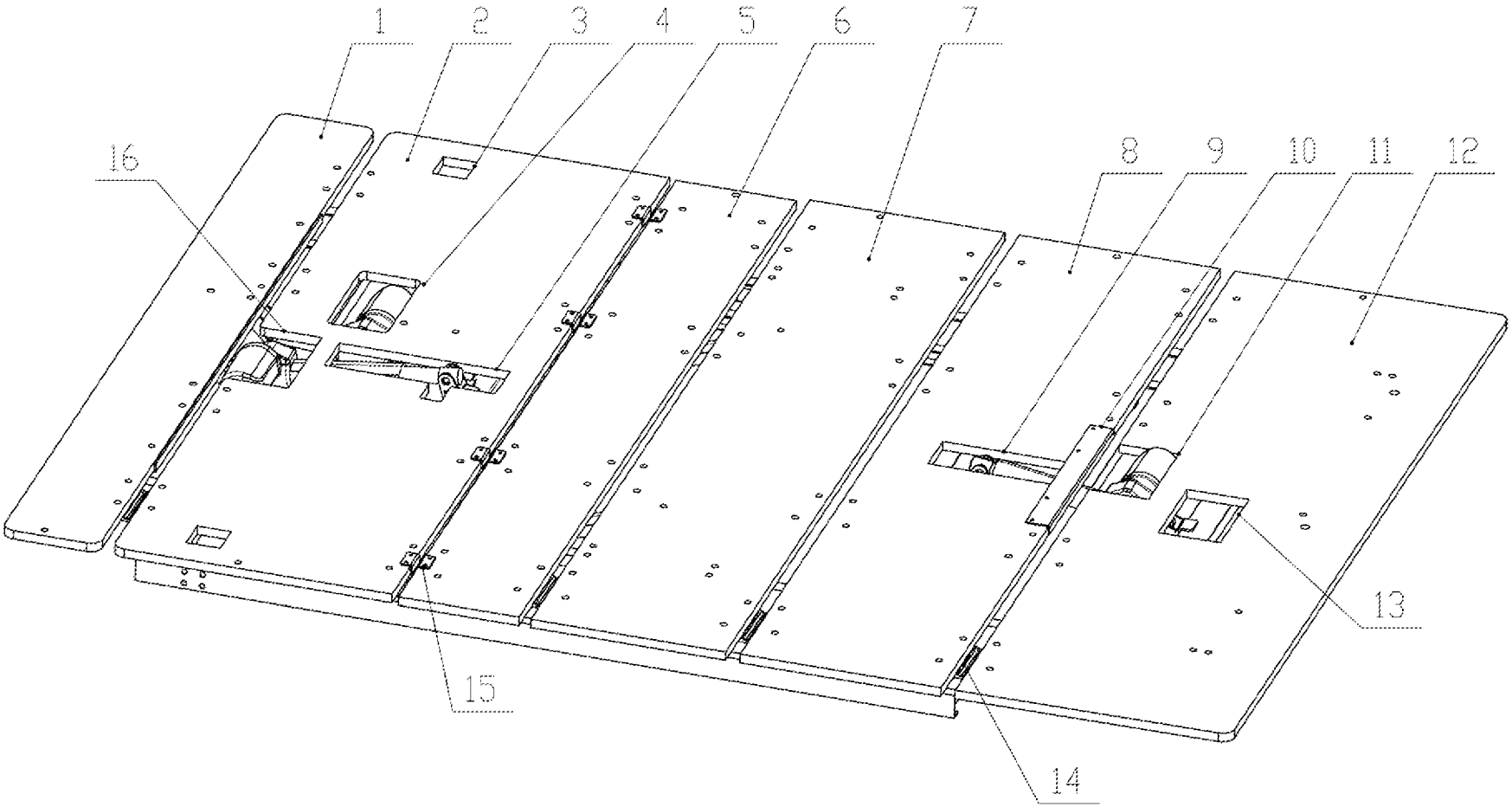
FIG. 1 shows schematically a front perspective view of an adjustable bed according to one embodiment of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise.

Furthermore, relative terms, such as "lower" or "bottom" and "upper" or "top" may be used herein to describe one element's relationship to another element as illustrated in the figures. It will be understood that relative terms are intended to encompass different orientations of the device in addition to the orientation depicted in the figures. For example, if the device in one of the figures is turned over, elements described as being on the "lower" side of other elements would then be oriented on "upper" sides of the other elements. The exemplary term "lower", can therefore, encompasses both an orientation of "lower" and "upper" depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprises" and/or "comprising" or "includes" and/or "including" or "has" and/or "having", or "carry" and/or "carrying," or "contain" and/or "containing" or "involve" and/or "involving", and the like are to be open-ended, i.e., to mean including but not limited to. When used in this disclosure, they specify the presence of stated features, regions, integers, steps, operations, elements, and/or components, but do not preclude the presence or addition of one or more other features, regions, integers, steps, operations, elements, components, and/or groups thereof.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used in this disclosure, the phrase "at least one of A, B, and C" should be construed to mean a logical (A or B or C), using a non-exclusive logical OR. As used herein, the term "and/or" includes any and all combinations of one or more of the associated listed items.

As used in this disclosure, the term "platform(s)" refers to bed platform(s), or bed board(s).

The description will be made as to the embodiments of the invention in conjunction with the accompanying drawings in FIGS. 1-9. In accordance with the purposes of this invention, as embodied and broadly described herein, this invention, in one aspect, relates to an adjustable bed with tilting mechanisms.

Referring to FIGS. 1-9, the adjustable bed is shown according to one embodiment of the invention. The adjustable bed includes a bed frame 20, a back lifting assembly, a foot lifting assembly, a tilting mechanism 101, a plurality of platforms 1, 2, 6, 7, 8 and 12, and/or a head platform tilting actuator 26.

The tilting mechanism 101 is coupled to the bed frame 20 for operably adjusting the bed frame 20 from a horizontal position to a sloping position or vice versa. The tilting mechanism 101 comprises a base frame 18 pivotally and detachably connected to the bed frame 20; and a bed frame tilting actuator 19 pivotally connected to the bed frame 20 and the base frame 18 for operably adjusting the bed frame 20 from the horizontal position to the sloping position or vice versa.

The bed frame 20 includes a pair of side rails 20*a* and 20*b*, an upper rail 20*c*, a lower rail 20*d* and an intermediate rail 20*e*. The pair of side rails 20*a* and 20*b* is transversely spaced, longitudinally aligned and arranged parallel to each other. Each side rail 20*a*/20*b* has a first end and an opposite, second end. The upper rail 20*c* and the lower rail 20*d* are longitudinally spaced and transversely aligned. Two ends of the upper rail 20*c* are connected to the first ends of the pair of side rails 20*a* and 20*b*; two ends of the lower rail 20*d* are connected to the second ends of the pair of side rails 20*a* and 20*b*; and two ends of the intermediate rail 20*e* are connected to the pair of side rails 20*a* and 20*b* at a position between the first ends and the second ends of the pair of side rails 20*a* and 20*b*, such that the upper rail 20*c*, the lower rail 20*d* and the intermediate rail 20*e* are parallel to each other. As clearly shown in FIGS. 2-6 and 8-9, each of the pair of side rails 20*a* and 20*b*, the upper rail 20*c*, the lower rail 20*d* and the intermediate rail 20*e* is a straight rail.

Figure 3:
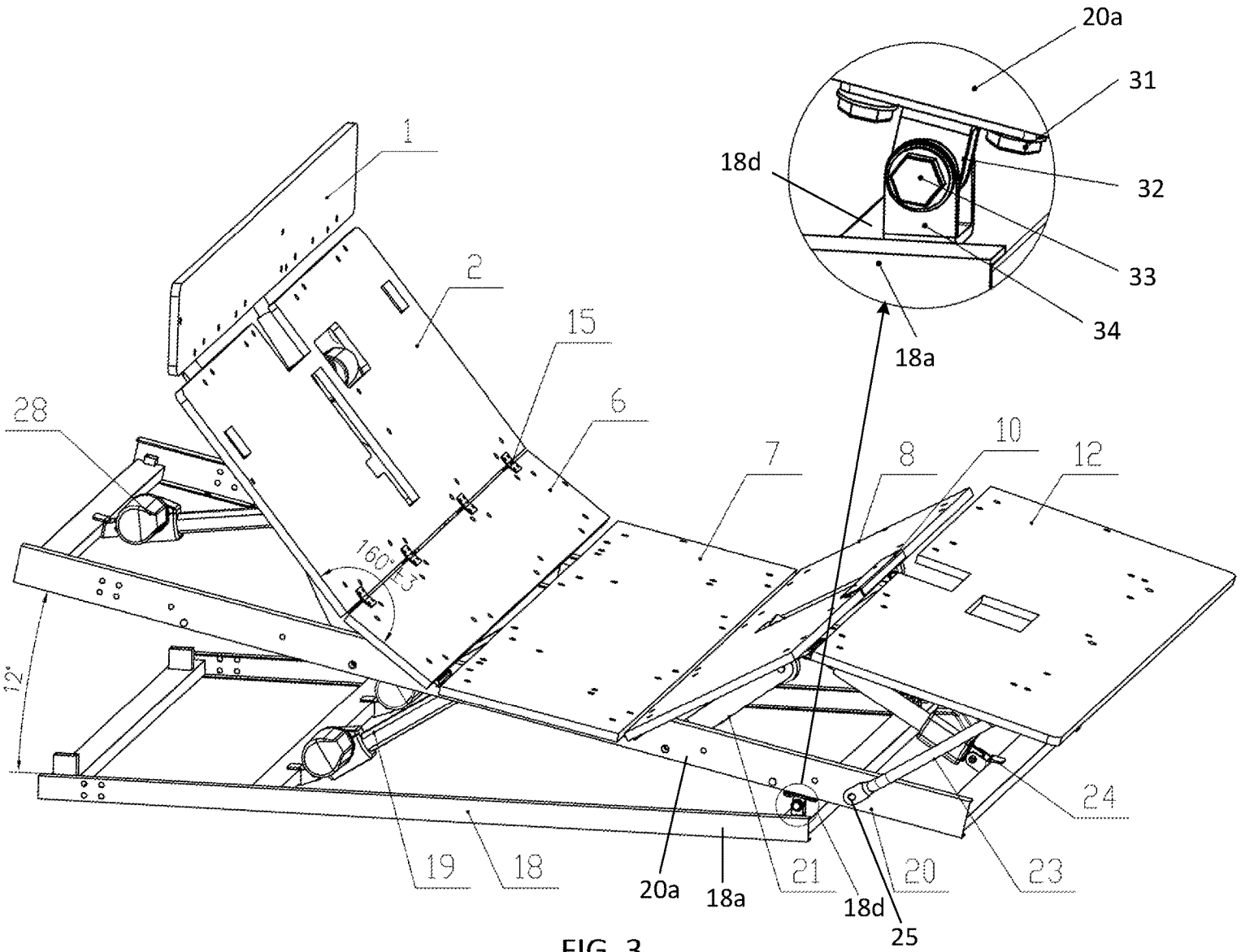
FIG. 3 shows schematically a front perspective view of the adjustable bed shown in FIG. 1 in a sloping position.
Figure 4:
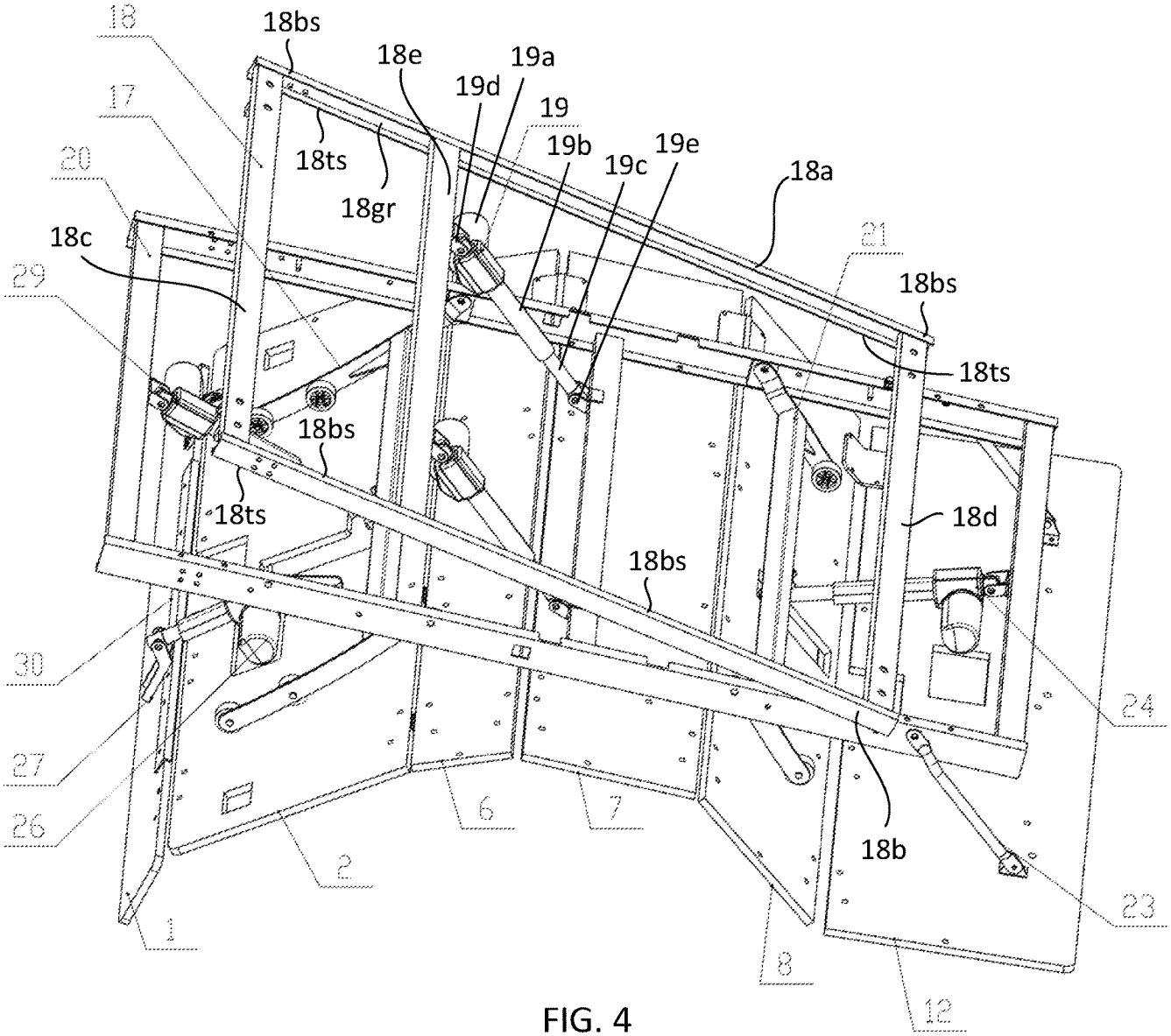
FIG. 4 shows schematically a back perspective view of the adjustable bed shown in FIG. 1 in a sloping position.
Figure 5:
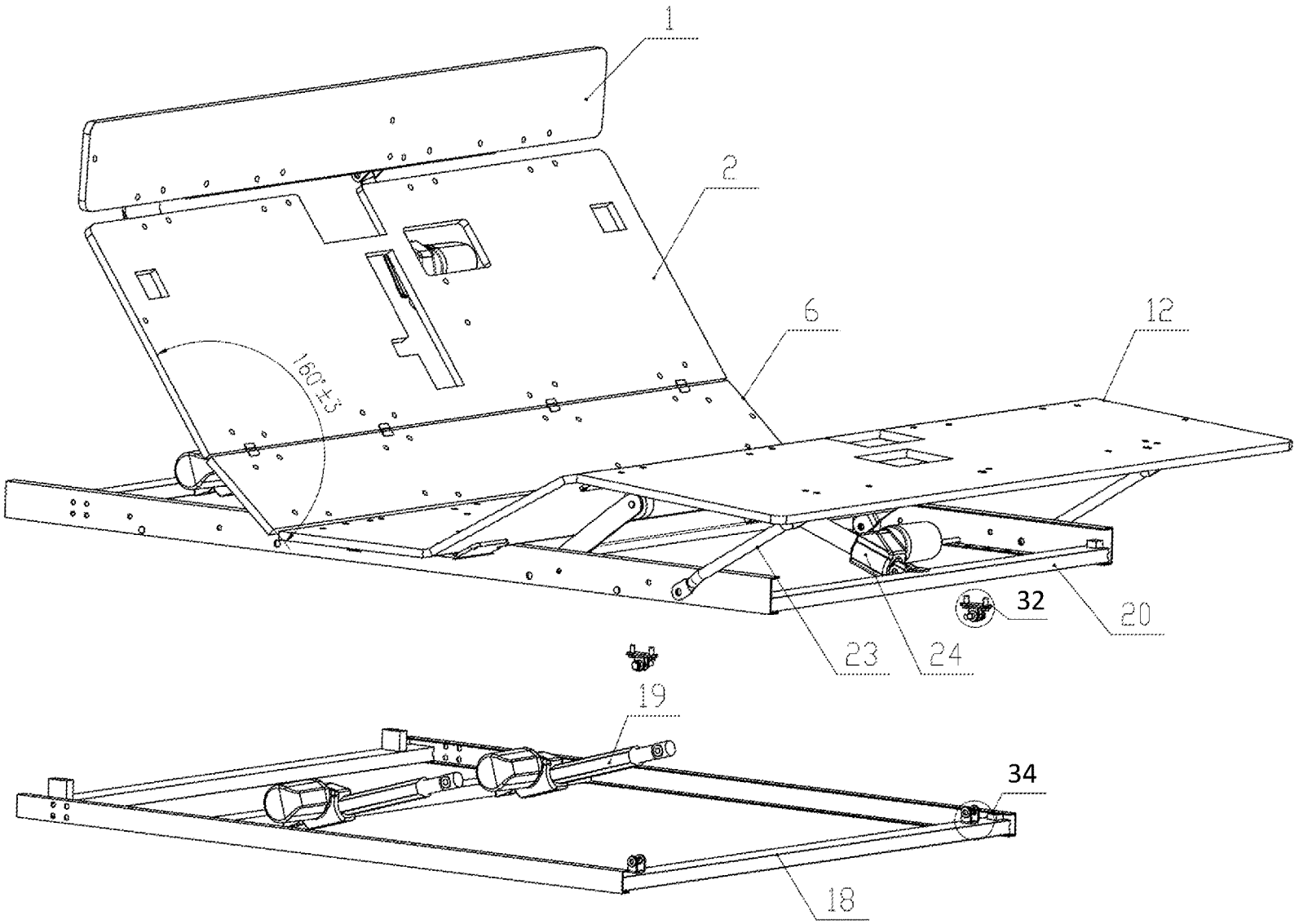
FIG. 5 shows schematically another front perspective view of the adjustable bed shown in FIG. 1 in a sloping position with a base frame detached.
Figure 6:
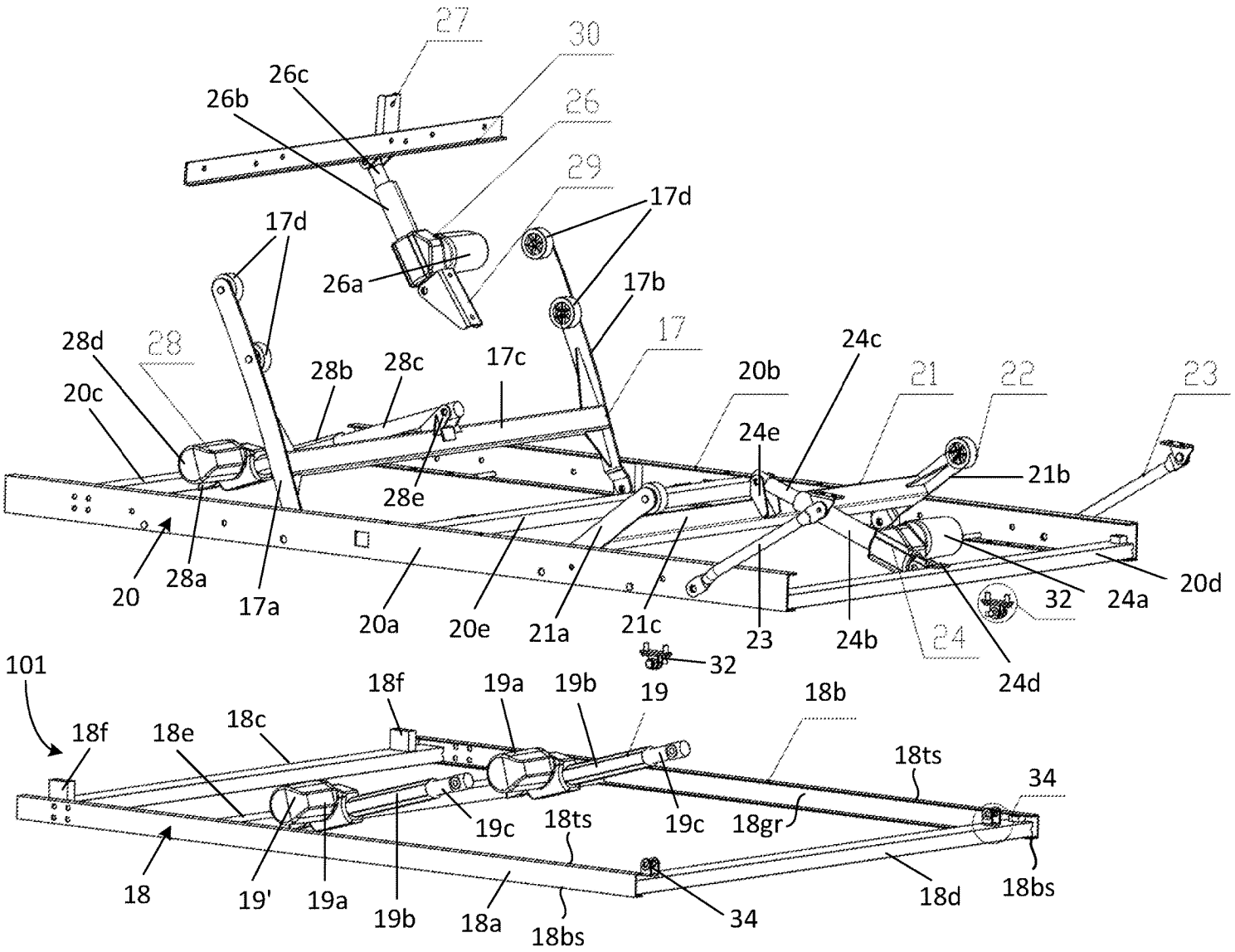
FIG. 6 shows schematically a front perspective view of the structures of the adjustable bed shown in FIG. 1.

The base frame 18 comprises a pair of side rails 18*a* and 18*b*, an upper rail 18*c*, a lower rail 18*d* and an intermediate rail 18*e*. The pair of side rails 18*a* and 18*b* is transversely spaced, longitudinally aligned and arranged parallel to each other. Each side rail 18*a*/18*b* has a first end and an opposite, second end. The upper rail 18*c*, the lower rail 18*d* and the intermediate rail 18*e* are longitudinally spaced and transversely aligned. Two ends of the upper rail 18*c* are directly connected to the first ends of the pair of side rails 18*a* and 18*b*; two ends of the lower rail 18*d* are directly connected to the second ends of the pair of side rails 18*a* and 18*b*; and two ends of the intermediate rail 18*e* are directly connected to the pair of side rails 18*a* and 18*b* at a position between the first ends and the second ends of the pair of side rails 18*a* and 18*b*, such that the upper rail 18*c*, the lower rail 18*d* and the intermediate rail 18*e* are parallel to each other. As clearly shown in FIGS. 2-6 and 8-9, each of the pair of side rails 18*a* and 18*b*, the upper rail 18*c*, the lower rail 18*d* and the intermediate rail 18*e* is a straight rail. Each of the pair of straight side rails 18*a* and 18*b* has a top surface 18*ts* and an opposite, bottom surface 18*bs*, such that the two ends of each of the straight upper rails 18*c*, the straight intermediate rail 18*e* and the straight lower rail 18*d* are located between the top surface 18*ts* and the bottom surface 18*bs* of the pair of straight side rails 18*a* and 18*b*, as shown in FIGS. 4 and 6. Further, each of the pair of straight side rails 18*a* and 18*b* also has a groove 18*gr* defined between the top surface 18*ts* and the bottom surface 18*bs* and extending from the first end to the second end, such that the two ends of each of the straight upper rails 18*c*, the straight intermediate rail 18*e* and the straight lower rail 18*d* are directly connected to the pair of straight side rails 18*a* and 18*b* in the groove 18*gr* thereof, as shown in FIGS. 4 and 6. In addition, as shown in FIG. 6, two end portions of the upper rails 18*c* are provided with two posts 18*f*, respectively. The post 18*f* is adapted to support the bed frame 20 when the bed frame 20 is in the horizontal position.

Figure 7A:
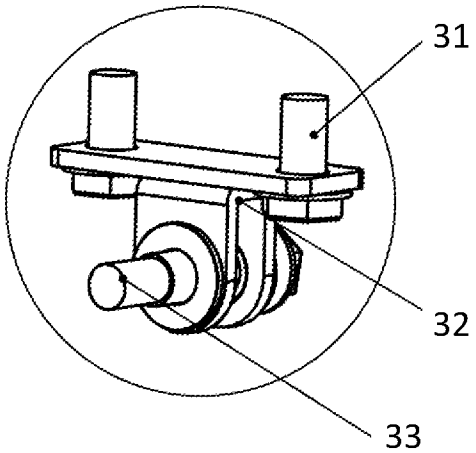
FIG. 7A-7D show schematically a first U-shaped bracket (FIG. 7A), a second U-shaped bracket (FIG. 7B), and their operation states (FIGS. 7C-7D) in the adjustable bed shown in FIG. 1.
Figure 7B:
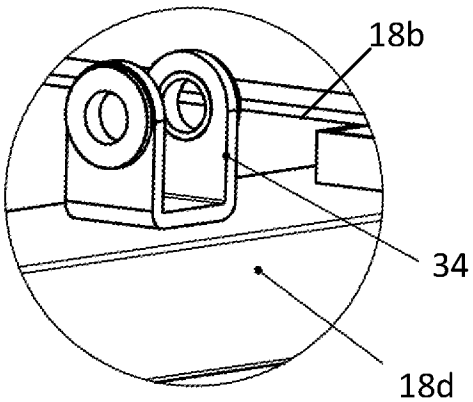
Figure 7C:
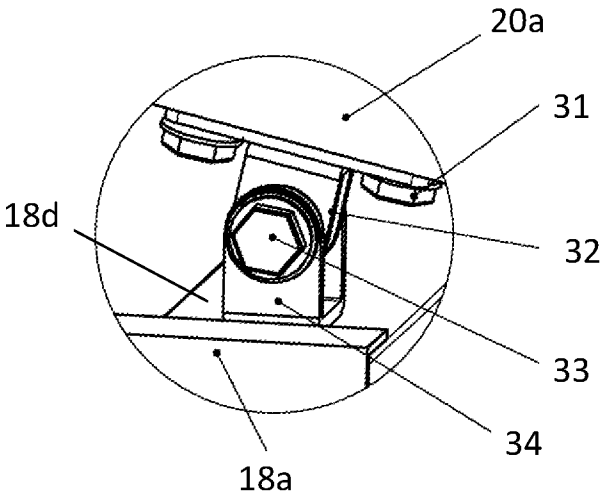
Figure 7D:
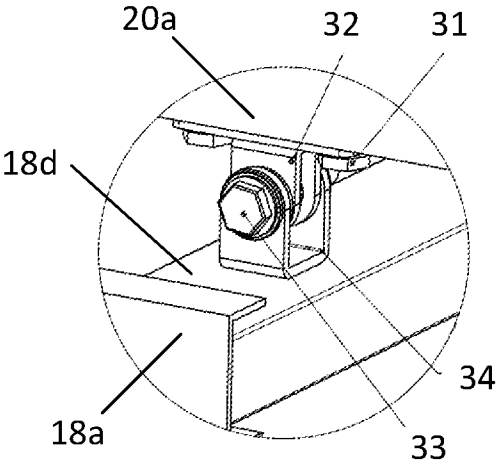
Figure 8:
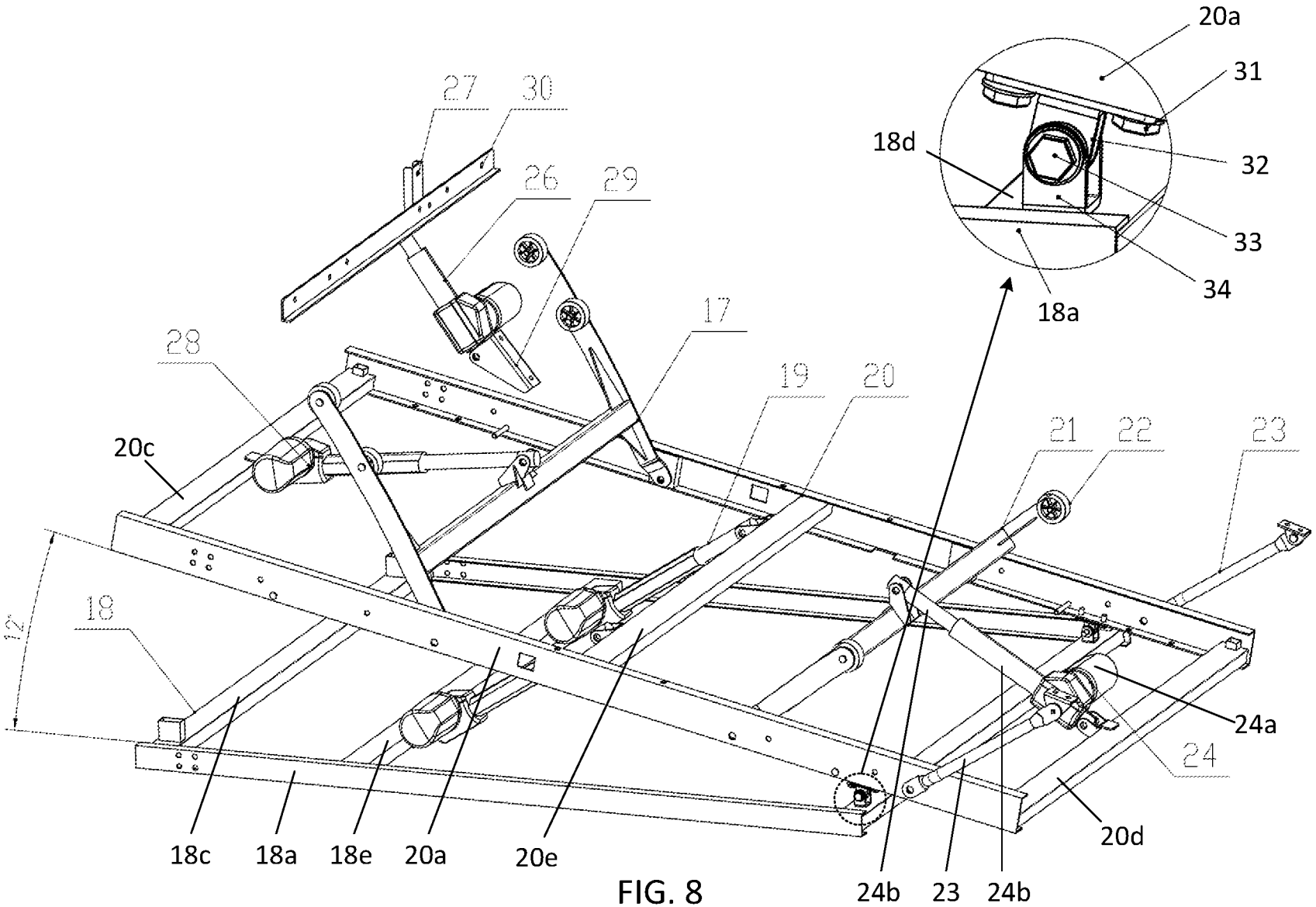
FIG. 8 shows schematically a front perspective view of the adjustable bed shown in FIG. 1 in a sloping position with a base frame attached.
Figure 9:
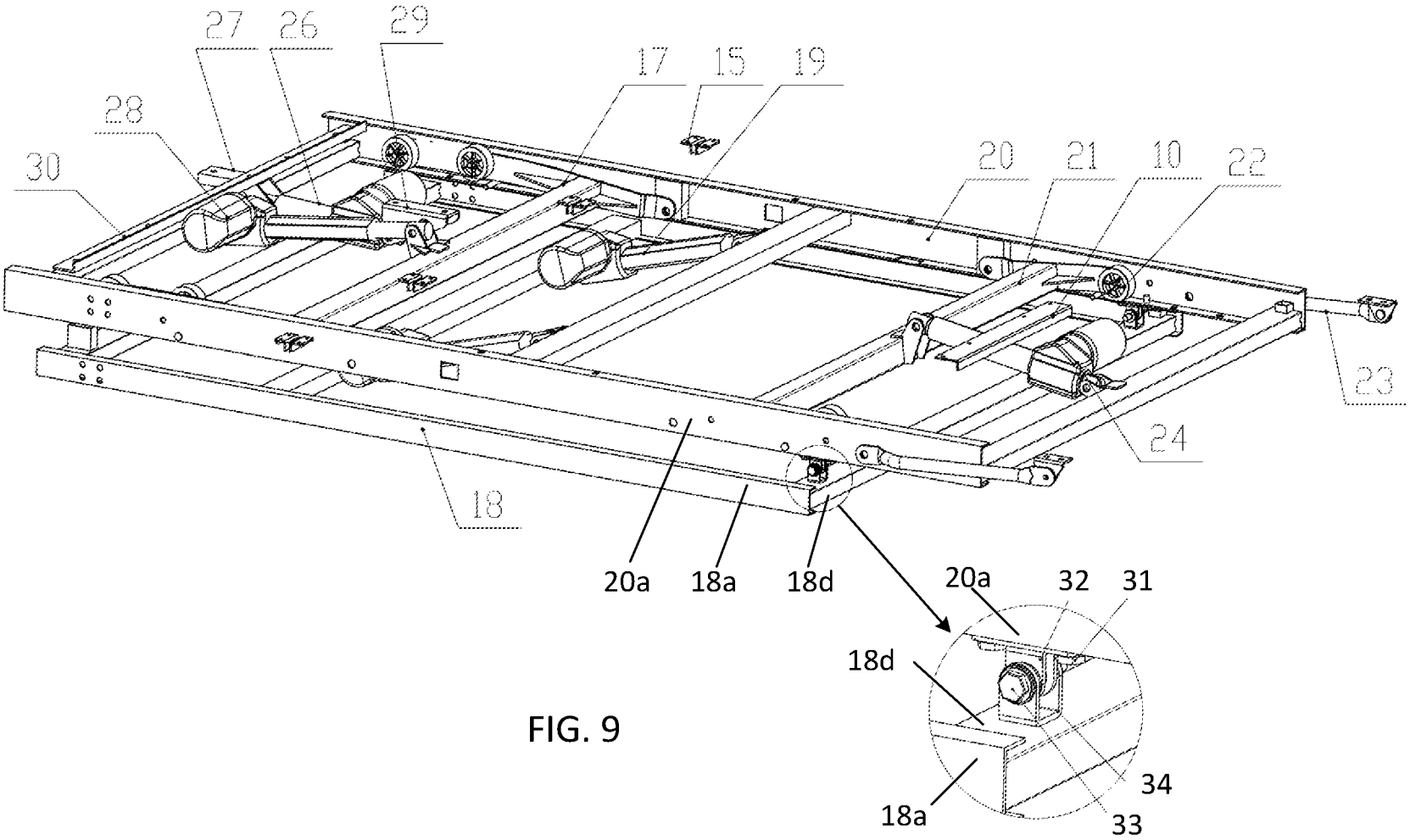
FIG. 9 shows schematically a front perspective view of the adjustable bed shown in FIG. 1 in a horizontal position.

The base frame 18 is pivotally and detachably connected to the bed frame 20. For example, a pair of first type U-shaped brackets 32 (FIG. 7A) is respectively mounted onto the pair of side rails 20*a* and 20*b* of the bed frame 20 using bolts/screws 31 at positions proximate to the second ends of the pair of side rails 20*a* and 20*b*, as shown in FIGS. 3, 8 and 9. A pair of second type U-shaped brackets 34 (FIG. 7B) is mounted onto the lower rail 18*d* of the base frame 18 at positions respectively proximate to the two ends of the lower rail 18*d*, as shown in FIGS. 3-9. Then, the pair of first brackets 32 are the pair of second brackets 34 are pivotally connected to each other using a pair of shoulder bolts 33, respectively, as shown in FIGS. 7A, 7C and 7D.

It should be appreciated that the base frame 18 can be pivotally and detachably connected to the bed frame 20 using other connecting means.

In addition, it should be appreciated that the adjustable bed can be used without base frame 18.

The bed frame tilting actuator comprises one or more actuator. In this exemplary embodiment shown in FIGS. 1-9, two bed frame tilting actuators 19 and 19' are utilized. Each actuator 19/19' has a motor member 19*a*, an outer tube 19*b* extending from the motor member 19*a*, an activation rod 19*c* received in the outer tube 19*b*, engaged with the motor member 19*a* and configured to be telescopically expandable or contractible relative to relative to the outer tube 19*b* according to a direction of motor rotation. In this exemplary embodiment shown in FIGS. 1-9, particularly in FIG. 4, the motor member 19*a* is pivotally connected to the intermediate rail 18*e* of the base frame 18 through a first mounting bracket 19*d*, and the activation rod 19*c* has a distal end portion pivotally connected to an intermediate rail 20*e* of the first bed frame 20 through a second mounting bracket 19*e*. As such, an expansion of the activation rod 19*c* causes the bed frame 20 to pivotally move in an upward rotation direction so as to adjust the bed frame 20 from the horizontal position to the sloping position. In one embodiment shown in FIGS. 3 and 8, the bed frame 20 is tilted/sloped at 12° relative to the base frame 18. It should be appreciated that the bed frame 20 can be tilted/sloped at other angles relative to the base frame 18, as desired. In addition, an contraction of the activation rod 19*c* causes the bed frame 20 to pivotally move in an downward rotation direction so as to adjust the bed frame 20 from the sloping position to the horizontal position, as shown FIGS. 1, 2 and 9.

In another embodiment, the motor member 19*a* can be pivotally connected to the upper rail 18*c* of the base frame 18 through a first mounting bracket 19*d*, and the activation rod 19*c* has a distal end portion pivotally connected to the intermediate rail 20*e* of the first bed frame 20 through a second mounting bracket 19*e*.

In yet another embodiment, the motor member 19*a* can be pivotally connected to the intermediate rail 20*e* of the first bed frame 20 through a mounting bracket 19*e*, and the activation rod 19*c* has a distal end portion pivotally connected to the upper rail 18*c* of the base frame 18 through a mounting bracket 19*d*.

The back lifting assembly includes a back lifting bracket 17 pivotally connected to the pair of side rails 20*a* and 20*b*, and a back lifting actuator 28 pivotally connected between the back lifting bracket 17 and the upper rail 20*c* for operably driving the back lifting bracket 17 to pivotally move in an upward rotation direction or a downward rotation direction relative to the bed frame 20.

As shown in FIG. 6, the back lifting bracket 17 comprises a pair of swing arms 17*a* and 17*b* and a middle bar 17*c*. The pair of swing arms 17*a* and 17*b* is transversely spaced and longitudinally extended, and rigidly connected to ends of the transversely extending middle bar 17*c* in an H-shaped form. Each of the pair of swing arms 17*a* and 17*b* has a first end portion and an opposite, second end portion. The first end portion of each swing arm 17*a*/17*b* is pivotally mounted to a respective one of the pair of side rails 20*a* and 20*b* of the bed frame 20 through a pivot. The second end portion of each of the pair of swing arms 17*a* and 17*b* is equipped with at least one back lifting wheel 17*d*. In this embodiment, two back lifting wheels 17*d* are installed on the second end portion of each of the pair of swing arms 17*a* and 17*b*. In addition, each of the pair of swing arms 17*a* and 17*b* are in an arc-shaped design. The swing arms 17*a* and 17*b* can be designed in other shapes.

The back lifting actuator 28 comprises a motor member 28*a*, an outer tube 28*b* extending from the motor member 28*a*, an activation rod 28*c* received in the outer tube 28*b*, engaged with the motor member 28*a* and configured to be telescopically expandable or contractible relative to the outer tube 28*b* according to a direction of motor rotation. In one embodiment, the motor member 28*a* is pivotally connected to the upper rail 20*c* of the bed frame 20 through a first mounting bracket 28*d*, and the activation rod 28*c* has a distal end portion pivotally connected to the middle bar 17*c* of the back lifting bracket 17 through a second mounting bracket 28*e*. Alternatively, the motor member 28*a* can be pivotally connected to the middle bar 17*c* of the back lifting bracket 17 through the mounting bracket 28*e*, and the distal end portion of the activation rod 28*c* can be pivotally connected to the upper rail 20*c* of the bed frame 20 through the mounting bracket 28*d*.

The foot lifting assembly includes a foot lifting bracket 21 pivotally connected to the pair of side rails 20*a* and 20*b*, and a foot lifting actuator 24 pivotally connected between the foot lifting bracket 21 and the lower rail 20*c* for operably driving the foot lifting bracket 21 to pivotally move in an upward rotation direction or a downward rotation direction relative to the bed frame 20.

The foot lifting bracket 21 comprises a pair of swing arms 21*a* and 21*b* and a middle bar 21*c*, wherein the pair of swing arms 21*a* and 21*b* is transversely spaced and longitudinally extended, and rigidly connected to ends of the transversely extending middle bar 21*c* in an H-shaped form, and each of the pair of swing arms 21*a* and 21*b* has a first end portion and an opposite, second end portion, wherein the first end portion of each swing arm 21*a*/21*b* is pivotally mounted to a respective one of the pair of side rails 20*a* and 20*b* of the bed frame 20 through a pivot. The second end portion of each of the pair of swing arms 24*a* and 24*b* is equipped with one foot lifting wheel 22.

The foot lifting actuator 24 comprises a motor member 24*a*, an outer tube 24*b* extending from the motor member 24*a*, an activation rod 24*c* received in the outer tube 24*b*, engaged with the motor member 24*a* and configured to be telescopically expandable or contractible relative to the outer tube 24*b* according to a direction of motor rotation. In one embodiment, the motor member 24*a* is pivotally connected to the lower rail 20*d* of the bed frame 20 through a first mounting bracket 24*d*, and the activation rod 24*c* has a distal end portion pivotally connected to the middle bar 21*c* of the foot lifting bracket 21 through a second mounting bracket 24*e*. Alternatively, the motor member 24*a* can be pivotally connected to the middle bar 21*c* of the foot lifting bracket 21 through the mounting bracket 24*e*, and the distal end portion of the activation rod 24*c* can be pivotally connected to the lower rail 20*d* of the bed frame 20 through the mounting bracket 24*d*.

As shown in FIGS. 1-5, the plurality of platforms comprises a head platform 1, a back platform 2, a waist platform 6, a seat platform 7, a thigh platform 8 and a foot platform 12, which are disposed on the bed frame 20. The head platform 1 is coupled to the back platform 2 through the head platform tilting actuator 26. The back platform 2 and the waist platform 6 are joined with angle limit brackets 15. The waist platform 6 is hinged with the seat platform 7 with one or more hinges 14. The seat platform 7 is, in turn, hinged with the thigh platform 8 with one or more hinges 14. The thigh platform 8 in, in turn, hinged with the foot platform 12 with one or more hinges 14. In addition, the seat platform 7 is mounted onto the bed frame 20.

The back platform 2 is movably coupled with the back lifting assembly, particularly supported by the back lifting bracket 17, and slidably movable along rotations of the two back lifting wheels 17*d* installed on the second end portion of each of the pair of swing arms 17*a* and 17*b*. Accordingly, when the activation rod 28*c* of the back lifting actuator 28 is expanded, it drives the back lifting bracket 17 to rotate in an upward rotation direction along the pivot point at in the first end portion of each swing arm 17*a*/17*b* of the the back lifting bracket 17, which in turn causes the back platform 2 to slidably move against the back lifting wheels 17*d* in the same upward rotation direction. When the back platform 2 moves in the same upward rotation direction to a certain position, the angle limit brackets 15 on the back platform 2 are against the angle limit brackets 15 on the waist platform 6, so that further movement of the back platform 2 causes the waist platform 6 to move accordingly. When the activation rod 28*c* of the back lifting actuator 28 is expanded at most, the back platform 2 has an angle relative to the waist platform 6, whereby the back platform 2 and the waist platform 6 are in positions that are comfortable for the user's back. In the exemplary embodiment shown in FIGS. 3 and 5, the angle can be 160°±3°. It should be appreciated that the angle can be in other angles.

Figure 2:
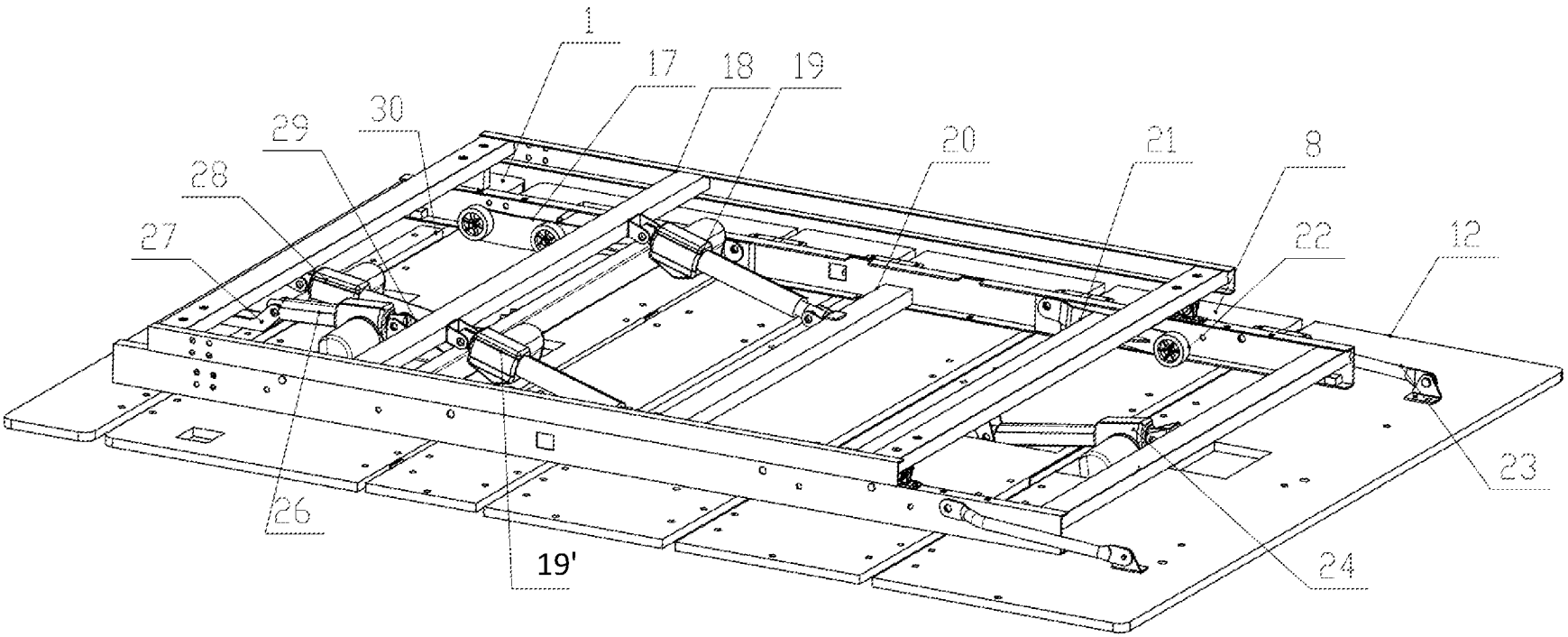
FIG. 2 shows schematically a back perspective view of the adjustable bed shown in FIG. 1.

When the activation rod 28*c* of the back lifting actuator 28 is contracted, it drives the back lifting bracket 17 to rotate in an downward rotation direction along the pivot point at the first end portion of each swing arm 17*a*/17*b* of the back lifting bracket 17, which in turn causes the back platform 2 to slidably move against the back lifting wheels 17*d* in the same downward rotation direction. The movement of the thigh platform 8 in the same downward rotation direction in turn causes the back platform 2 and the waist platform 6 to move, so that the back platform 2 and the waist platform 6 are in a flat position when the activation rod 28*c* of the back lifting actuator 28 is contracted at most, as shown in FIGS. 1-2.

The thigh platform 8 and the foot platform 12 are movably coupled with the foot lifting assembly. Particularly, the thigh platform 8 is supported by the foot lifting bracket 21 and slidably movable along rotations of the foot lifting wheel 22 installed on the second end portion of each of the pair of swing arms 21*a* and 21*b*. The foot platform 12 is mounted on one ends of a pair of foot support members 23, while the other ends of the pair of foot support members 23 are pivotally connected to the pair of side rails 20*a* and 20*b* of the bed frame 20, respectively, at a pivot 25 proximate to the second ends of the pair of side rails 20*a* and 20*b*, as shown in FIG. 3. As such, when the activation rod 24*c* of the foot lifting actuator 24 is expanded, it drives the foot lifting bracket 21 to rotate in an upward rotation direction along the pivot point at in the first end portion of each swing arm 21*a*/21*b* of the foot lifting bracket 21, which in turn causes the thigh platform 8 to slidably move against the foot lifting wheels 22 in the same upward rotation direction. The movement of the thigh platform 8 in the same upward rotation direction in turn causes the foot platform 12 to move accordingly, so that the thigh platform 8 and the foot platform 12 are in a desired adjusting position, as shown in FIGS. 3-5. When the activation rod 24*c* of the foot lifting actuator 24 is contracted, it drives the foot lifting bracket 21 to rotate in an downward rotation direction along the pivot point at in the first end portion of each swing arm 21*a*/21*b* of the foot lifting bracket 21, which in turn causes the thigh platform 8 to slidably move against the foot lifting wheels 22 in the same downward rotation direction. The movement of the thigh platform 8 in the same downward rotation direction in turn causes the foot platform 12 to move, so that the thigh platform 8 and the foot platform 12 are in a flat position when the activation rod 24*c* of the foot lifting actuator 24 is contracted at most, as shown in FIGS. 1-2.

In some embodiments, the back platform 2 has a few of openings 3, 4, 5 and 16. Of them, for example, opening 3 is for UBS ports, opening 4 is for accommodating the motor member 26*a* of the head platform tilting actuator 26; opening 16 is for accommodating the motor member 28*a* of the back lifting actuator 28; and opening 5 is for accommodating the activation rod 28*c* of the back lifting actuator 28. The thigh platform 8 may also have an opening 9 for housing the activation rod 24*c* of the back lifting actuator 24. The foot platform 12 may have an opening 13 for housing for a vibration or massage motor.

The head platform tilting actuator 26 is pivotally connected to the head platform 1 and the back platform 2 for operably adjusting the head platform 1 in a tilting position or a flat position relative to the back platform 2. The head platform tilting actuator 26 comprises a motor member 26*a*, an outer tube 26*b* extending from the motor member 26*a*, an activation rod 26*c* received in the outer tube 26*b*, engaged with the motor member 26*a* and configured to be telescopically expandable or contractible relative to the outer tube 26*b* according to a direction of motor rotation. The motor member 26*a* is pivotally connected to the back platform 2 through a back platform mounting bracket 29 (FIGS. 6 and 8), and the distal end portion of the activation rod 26*c* is pivotally connected to the head platform 1 through a head platform mounting bracket (FIGS. 6 and 8) having a reinforcement angle bracket 30 holding a lower edge portion of the head platform 1 and a mounting bracket 27 protruded from the reinforcement angle bracket 30 and mounted onto the head platform 1. As such, an expansion of the activation rod 26*c* of the head platform tilting actuator 26 causes the head platform 1 to pivotally move in an upward rotation direction so as to adjust the head platform 1 from the flat position to the tilting position, as shown in FIGS. 3-5, and an contraction of the activation rod 26*c* of the head platform tilting actuator 26 causes the head platform to pivotally move in an downward rotation direction so as to adjust the head platform 1 from the tilting position to the flat position, as shown in FIGS. 1-2.

The adjustable bed also includes a controller (not shown) configured to control operations of the head platform tilting actuator 26, the back lifting actuator 28, the foot lifting actuator 24, and the bed frame tilting actuator 19, respectively, so as to adjust individually or cooperatively the head platform 1, the back lifting platform 2, the thigh platform 8, the leg platform 12, and the bed frame 20 in desired positions, as described above.

According to the invention, the adjustable bed is capable of adjusting body positions at user's preference to achieve maximum comfort when using the bed.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. An adjustable bed, comprising:

a bed frame comprising a pair of side rails, an upper rail and a lower rail, wherein the pair of side rails is transversely spaced, longitudinally aligned and arranged parallel to each other, each side rail having a first end and an opposite, second end; and the upper rail and the lower rail are longitudinally spaced and transversely aligned, two ends of the upper rail being connected to the first ends of the pair of side rails and two ends of the lower rail being connected to the second ends of the pair of side rails such that the upper rail and the lower rail are parallel to each other, wherein each of the pair of side rails, the upper rail, the lower rail and the intermediate rail is a straight rail;

a back lifting assembly comprising a back lifting bracket pivotally connected to the pair of side rails, and a back lifting actuator pivotally connected between the back lifting bracket and the upper rail for operably driving the back lifting bracket to pivotally move in an upward rotation direction or a downward rotation direction relative to the bed frame;

a foot lifting assembly comprising a foot lifting bracket pivotally connected to the pair of side rails, and a foot lifting actuator pivotally connected between the foot lifting bracket and the lower rail for operably driving the foot lifting bracket to pivotally move in an upward rotation direction or a downward rotation direction relative to the bed frame;

a tilting mechanism coupled to the bed frame for operably adjusting the bed frame from a horizontal position to a sloping position, or vice versa;

a plurality of platforms disposed on the bed frame, the plurality of platforms comprising a head platform, a back platform, a waist platform, a seat platform, a thigh platform and a foot platform, wherein the back platform is movably coupled with the back lifting assembly, the seat platform is mounted onto the bed frame, and the thigh platform and the foot platform are movably coupled with the foot lifting assembly, wherein the waist platform is connected to the seat platform with one or more hinges, the seat platform, in turn, is connected to the thigh platform with one or more hinges, and the thigh platform, in turn, is connected to the foot platform with one or more hinges, and wherein the back platform and the waist platform are joined with angle limit brackets such that when the back platform moves in an upward rotation direction to a certain position, the angle limit brackets on the back platform are against the angle limit brackets on the waist platform so that further movement of the back platform in the same upward rotation direction causes the waist platform to move accordingly; and a head platform tilting actuator pivotally connected to the head platform and the back platform for operably adjusting the head platform in a tilting position or a flat position relative to the back platform, wherein the head platform tilting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the back platform by a back platform mounting bracket that is directly mounted on the back platform, and the activation rod has a distal end portion pivotally connected to the head platform by a head platform mounting bracket having a reinforcement angle bracket holding a lower edge portion of the head platform and a head mounting bracket protruded from the reinforcement angle bracket and directly mounted onto the head platform.

2. The adjustable bed of claim 1, wherein the tilting mechanism comprises:

a base frame pivotally and detachably connected to the bed frame; and a bed frame tilting actuator pivotally connected to the bed frame and the base frame for operably adjusting the bed frame from the horizontal position to the sloping position, or vice versa.

3. The adjustable bed of claim 2, wherein the base frame comprises a pair of side rails, an upper rail, a lower rail and an intermediate rail, wherein the pair of side rails is transversely spaced, longitudinally aligned and arranged parallel to each other, each side rail having a first end and an opposite, second end; wherein two ends of the upper rail are connected to the first ends of the pair of side rails; two ends of the lower rail are connected to the second ends of the pair of side rails; and two ends of the intermediate rail are connected to the pair of side rails at a position between the first ends and the second ends of the pair of side rails, such that the upper rail, the lower rail and the intermediate rail are parallel to each other.

4. The adjustable bed of claim 3, wherein the bed frame tilting actuator comprises at least one actuator, each actuator having a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the intermediate rail or the upper rail of the base frame through a first mounting bracket, and the activation rod has a distal end portion pivotally connected to an intermediate rail of the bed frame through a second mounting bracket, such that an expansion of the activation rod causes the bed frame to pivotally move in an upward rotation direction so as to adjust the bed frame from the horizontal position to the sloping position, and a contraction of the activation rod causes the bed frame to pivotally move in a downward rotation direction so as to adjust the bed frame from the sloping position to the horizontal position.

5. The adjustable bed of claim 3, wherein a pair of first brackets is respectively connected to the pair of side rails of the bed frame at positions proximate to the second ends of the pair of side rails; a pair of second brackets is connected to the lower rail of the base frame at positions respectively proximate to the two ends of the lower rail; and wherein the base frame is pivotally connected to the bed frame through a pair of shoulder bolts pivotally connecting the pair of first brackets to the pair of second brackets, respectively.

6. The adjustable bed of claim 1, wherein the back lifting bracket comprises a pair of swing arms and a middle bar, wherein the pair of swing arms is transversely spaced and longitudinally extended, and rigidly connected to ends of the transversely extending middle bar in an H-shaped form, and each of the pair of swing arms has a first end portion and an opposite, second end portion, wherein the first end portion of each swing arm is pivotally mounted to a respective one of the pair of side rails of the bed frame through a pivot; and the back lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the upper rail of the bed frame through a first mounting bracket, and the activation rod has a distal end portion pivotally connected to the middle bar of the back lifting bracket through a second mounting bracket.

7. The adjustable bed of claim 6, wherein the second end portion of each of the pair of swing arms is equipped with at least one back lifting wheel.

8. The adjustable bed of claim 1, wherein the foot lifting bracket comprises a pair of swing arms and a middle bar, wherein the pair of swing arms is transversely spaced and longitudinally extended, and rigidly connected to ends of the transversely extending middle bar in an H-shaped form, and each of the pair of swing arms has a first end portion and an opposite, second end portion, wherein the first end portion of each swing arm is pivotally mounted to a respective one of the pair of side rails of the bed frame through a pivot; and the foot lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the lower rail of the bed frame through a first mounting bracket, and the activation rod has a distal end portion pivotally connected to the middle bar of the foot lifting bracket through a second mounting bracket.

9. The adjustable bed of claim 8, wherein the second end portion of each of the pair of swing arms and is equipped with at least one foot lifting wheel.

10. The adjustable bed of claim 2, further comprising a controller configured to control operations of the head platform tilting actuator, the back lifting actuator, the foot lifting actuator, and the bed frame tilting actuator, respectively, so as to adjust individually or cooperatively the head platform, the back lifting platform, the thigh platform, the leg platform, and the bed frame in desired positions.

11. An adjustable bed, comprising:

a bed frame for supporting a plurality of platforms having at least a head platform and a back platform, wherein the bed frame comprises a pair of side rails, an upper rail, a lower rail and an intermediate rail arranged in a rectangle form;

a base frame pivotally and detachably connected to the bed frame, wherein the base frame comprises a pair of straight side rails, a straight upper rail, a straight lower rail and a straight intermediate rail arranged in a rectangle form, wherein each of the pair of straight side rails has a first end and an opposite, second end, two ends of the straight upper rail are directly connected to the first ends of the pair of straight side rails, two ends of the straight lower rail are directly connected to the second ends of the pair of straight side rails, and two ends of the straight intermediate rail are directly connected to the pair of straight side rails at a position between the first ends and the second ends of the pair of straight side rails, wherein each of the pair of straight side rails has a top surface and an opposite, bottom surface, such that the two ends of each of the straight upper rail, the straight intermediate rail and the straight lower rail are located between the top surface and the bottom surface of the pair of straight side rails;

a bed frame tilting actuator pivotally connected to the bed frame and the base frame for operably adjusting the bed frame from a horizontal position to a sloping position, or vice versa, wherein the bed frame tilting actuator comprises at least one actuator, each actuator having a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the straight intermediate rail or the straight upper rail of the base frame, and the activation rod has a distal end portion pivotally connected to the intermediate rail of the bed frame, such that an expansion of the activation rod causes the bed frame to pivotally move in an upward rotation direction so as to adjust the bed frame from the horizontal position to the sloping position, and a contraction of the activation rod causes the bed frame to pivotally move in a downward rotation direction so as to adjust the bed frame from the sloping position to the horizontal position; and a head platform tilting actuator pivotally connected to the head platform and the back platform for operably adjusting the head platform in a tilting position or a flat position relative to the back platform; wherein the head platform tilting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the back platform by a back platform mounting bracket that is directly mounted on the back platform, and the activation rod has a distal end portion pivotally connected to the head platform by a head platform mounting bracket having a reinforcement angle bracket holding a lower edge portion of the head platform and a head mounting bracket protruded from the reinforcement angle bracket and directly mounted onto the head platform.

12. The adjustable bed of claim 11, wherein the bed frame tilting actuator comprises at least one actuator, each actuator having a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the intermediate rail or the upper rail of the base frame through a first mounting bracket, and the activation rod has a distal end portion pivotally connected to the intermediate rail of the bed frame through a second mounting bracket, such that an expansion of the activation rod causes the bed frame to pivotally move in an upward rotation direction so as to adjust the bed frame from the horizontal position to the sloping position, and a contraction of the activation rod causes the bed frame to pivotally move in a downward rotation direction so as to adjust the bed frame from the sloping position to the horizontal position.

13. The adjustable bed of claim 11, further comprising a back lifting assembly comprising a back lifting bracket pivotally connected to the pair of side rails, and a back lifting actuator pivotally connected between the back lifting bracket and the upper rail for operably driving the back lifting bracket to pivotally move in an upward rotation direction or a downward rotation direction relative to the bed frame;

wherein the back lifting bracket comprises a pair of swing arms and a middle bar, wherein the pair of swing arms is transversely spaced and longitudinally extended, and rigidly connected to ends of the transversely extending middle bar in an H-shaped form, and each of the pair of swing arms has a first end portion and an opposite, second end portion, wherein the first end portion of each swing arm is pivotally mounted to a respective one of the pair of side rails of the bed frame through a pivot; and wherein the back lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the upper rail of the bed frame through a first mounting bracket, and the activation rod has a distal end portion pivotally connected to the middle bar of the back lifting bracket through a second mounting bracket.

14. The adjustable bed of claim 11, further comprising:

a foot lifting assembly comprising a foot lifting bracket pivotally connected to the pair of side rails, and a foot lifting actuator pivotally connected between the foot lifting bracket and the lower rail for operably driving the foot lifting bracket to pivotally move in an upward rotation direction or a downward rotation direction relative to the bed frame, wherein the foot lifting bracket comprises a pair of swing arms and a middle bar, wherein the pair of swing arms is transversely spaced and longitudinally extended, and rigidly connected to ends of the transversely extending middle bar in an H-shaped form, and each of the pair of swing arms has a first end portion and an opposite, second end portion, wherein the first end portion of each swing arm is pivotally mounted to a respective one of the pair of side rails of the bed frame through a pivot; and wherein the foot lifting actuator comprises a motor member, an outer tube extending from the motor member, an activation rod received in the outer tube, engaged with the motor member and configured to be telescopically expandable or contractible relative to the outer tube according to a direction of motor rotation, wherein the motor member is pivotally connected to the lower rail of the bed frame through a first mounting bracket, and the activation rod has a distal end portion pivotally connected to the middle bar of the foot lifting bracket through a second mounting bracket.

* * * * *